US009187906B2

(12) United States Patent
Iyoda

(10) Patent No.: US 9,187,906 B2
(45) Date of Patent: Nov. 17, 2015

(54) HANDRAIL

(75) Inventor: Mutsumi Iyoda, Tokyo (JP)

(73) Assignee: Mutsumi Iyoda, Tokyo (JP)

( * ) Notice: Subject to any disclaimer, the term of this patent is extended or adjusted under 35 U.S.C. 154(b) by 0 days.

(21) Appl. No.: 13/810,043

(22) PCT Filed: Jul. 8, 2011

(86) PCT No.: PCT/JP2011/065677

§ 371 (c)(1),
(2), (4) Date: Jan. 14, 2013

(87) PCT Pub. No.: WO2012/008375

PCT Pub. Date: Jan. 19, 2012

(65) Prior Publication Data

US 2013/0112932 A1 May 9, 2013

(30) Foreign Application Priority Data

Jul. 12, 2010 (JP) ..... 2010-158238

(51) Int. Cl.
*E04F 11/18* (2006.01)

(52) U.S. Cl.
CPC ..... *E04F 11/1808* (2013.01); *E04F 11/1804* (2013.01)

(58) Field of Classification Search
CPC ..... E04F 11/1802; E04F 11/1804; E04F 11/1808; E04F 2011/1802; E04F 2011/1887
USPC ..... 256/59, 65.01, 65.16; D25/38.1, 119, D25/164; 248/692; 52/656.7
See application file for complete search history.

(56) References Cited

U.S. PATENT DOCUMENTS

| | | | | | |
|---|---|---|---|---|---|
| 2,886,278 | A | * | 5/1959 | Opie | 248/251 |
| 3,298,147 | A | * | 1/1967 | Haberman | 52/288.1 |
| 3,991,537 | A | * | 11/1976 | Brown | 52/718.05 |
| D345,020 | S | * | 3/1994 | Audia | D25/136 |
| 5,752,356 | A | * | 5/1998 | Miklavic et al. | 52/718.02 |

(Continued)

FOREIGN PATENT DOCUMENTS

| | | | |
|---|---|---|---|
| JP | 3024458 | U | 2/1996 |
| JP | 2000-220270 | A | 8/2000 |

(Continued)

OTHER PUBLICATIONS

PCT, "International Search Report for PCT/JP2011/065677", Aug. 2, 2011.

*Primary Examiner* — Joshua Kennedy
(74) *Attorney, Agent, or Firm* — Manabu Kanesaka

(57) ABSTRACT

A handrail includes a top surface having a first flat portion extending in a first direction, a first finger rest portion continuously extending downward, and a second flat portion continuously extending in the first direction; a front surface having a flat first guiding portion continuously extending downward, a second finger rest portion continuously extending in a second direction opposite to the first direction, a second guiding portion continuously projecting downward in an arc shape, a third guiding portion continuously projecting downward in an arc shape in the second direction, and a third finger rest portion formed from a boundary between the second guiding portion and the third guiding portion extending upward. The handrail is structured so that when the handrail is grasped, fingers are placed on any one of the first finger rest portion, the second finger rest portion, or the third finger rest portion.

2 Claims, 6 Drawing Sheets

(56) References Cited

U.S. PATENT DOCUMENTS

| | | | | |
|---|---|---|---|---|
| 6,270,058 | B1 * | 8/2001 | Williams et al. | 256/59 |
| 6,425,216 | B1 * | 7/2002 | Gardner | 52/204.53 |
| D510,631 | S * | 10/2005 | Hsu | D25/119 |
| 7,093,825 | B2 * | 8/2006 | Kawamura et al. | 256/59 |
| D674,122 | S * | 1/2013 | Sims | D25/119 |
| 2003/0193048 | A1 | 10/2003 | Kawamura et al. | |

FOREIGN PATENT DOCUMENTS

| | | | |
|---|---|---|---|
| JP | 2000-240250 | A | 9/2000 |
| JP | 2000-274040 | A | 10/2000 |
| JP | 2003-301582 | A | 10/2003 |
| JP | 2004-218327 | A | 8/2004 |
| JP | 2005-042345 | A | 2/2005 |

* cited by examiner

HANDRAIL

BACKGROUND OF THE INVENTION

1. Field of Invention

The present invention relates to a handrail mounted on a wall, a hallway, a staircase or other structure.

Conventionally handrails have been mounted on walls, hallways, staircases and other structures, and various forms of handrails have been developed to assist movement of people with walking difficulty such as elderly people.

Patent Literature 1 discloses a handrail having a flat top surface capable of supporting the body of a user while the user is sliding a hand or an elbow part thereof (FIG. 8). Unfortunately, the handrail in FIG. 8 does not assume a case where the handrail is grasped with fingers of the user, and thus the fingers cannot be smoothly guided when the user of the handrail walks while grasping the handrail from various directions depending on the position and muscle strength of the body of the user. Patent Literature 2 discloses a handrail assuming that the handrail is grasped by a hand of a user (FIG. 9), but unfortunately the handrail in FIG. 9 is not devised to guide the fingers of the hand smoothly and safely when the user walks while grasping the handrail. The handrails disclosed in Patent Literature 3 and Patent Literature 4 have the same problem as described above.

It is often difficult for people with walking difficulty such as elderly people, physically challenged people, and healthy people in poor physical condition to grasp a handrail and thus the handrail is required to be easily grasped. In addition, when a person walks using a handrail, the person needs to re-grasp the handrail and change the direction of grasping according to the movement of the body of the person, and thus the handrail is preferably formed so as to smoothly guide the fingers of the person, but conventionally such a handrail is not found.

2. Description of Related Art

Patent Literature 1: Japanese Patent Application Laid-Open No. 2004-218327

Patent Literature 2: Japanese Patent Application Laid-Open No. 2000-274040

Patent Literature 3: Japanese Patent Application Laid-Open No. 2000-240250

Patent Literature 4: Japanese Patent Application Laid-Open No. 2000-220270

BRIEF SUMMARY OF THE INVENTION

It is an object of the present invention to provide a handrail that is easy to grasp and enables smooth guidance of fingers during walking with the fingers grasping the handrail. Further, it is another object of the present invention to provide a handrail that can also be used even by healthy people in poor physical conditions, might not look like a handrail at first glance, and may be formed to fit into the mounting location.

The problems are solved by a handrail wherein a first flat portion that is flat and extends in a front direction, a first finger rest portion that extends 1 cm downward, and a second flat portion that is flat and extends in the front direction are continuous with each other on a top surface; a flat first guiding portion that is continuous with the second flat portion and extends downward, a second finger rest portion that is flat and extends in a rear direction, a second guiding portion that projects downward in an arc shape, and a third guiding portion that extends projecting downward in an arc shape in the rear direction are continuous with each other on a front surface; and a boundary between the second guiding portion and the third guiding portion forms a third finger rest portion that extends upward, so that when the handrail is grasped, fingers are placed on any one of the first finger rest portion, the second finger rest portion, or the third finger rest portion.

Specifically, the first finger rest portion is a portion with a step height of 1 cm at a boundary between the first flat portion and the second flat portion extending parallel thereto.

The problems are solved by a handrail wherein a first flat portion that is flat and extends in a front direction, a first finger rest portion that extends several millimeters downward, and a second flat portion that is flat and extends in the front direction are continuous with each other on a top surface; a flat first guiding portion that is continuous with the second flat portion and extends downward, a second finger rest portion that is flat and extends in a rear direction, a second guiding portion that projects downward in an arc shape, and a third guiding portion that extends projecting downward in an arc shape in the rear direction are continuous with each other on a front surface; and a boundary between the second guiding portion and the third guiding portion forms a third finger rest portion that extends upward, so that when the handrail is grasped, fingers are placed on any one of the first finger rest portion, the second finger rest portion, or the third finger rest portion.

Specifically, in this case, the first finger rest portion is a portion with a step height of several millimeters at a boundary between the first flat portion and the second flat portion extending parallel thereto.

The handrail may be formed of wood, metal, resin or any other material as long as the material can be formed.

In addition, the problems are solved by a handrail wherein a first flat portion that is flat and extends in a front direction, a first finger rest portion that extends 1 cm downward, and a second flat portion that is flat and extends in the front direction are continuous with each other on a top surface; a flat first guiding portion that is continuous with the second flat portion and extends downward, a second finger rest portion that is flat and extends in a rear direction, a second guiding portion that projects downward in an arc shape, and a third guiding portion that extends projecting downward in an arc shape in the rear direction are continuous with each other on a front surface; and a boundary between the second guiding portion and the third guiding portion forms a third finger rest portion that extends upward, so that when the handrail is grasped, fingers are placed on any one of the first finger rest portion, the second finger rest portion, or the third finger rest portion, the handrail being mounted on a wall by inserting the lower end of a handrail-side fitting whose upper end is mounted on the handrail and is pushed to one side in a leaf spring shape in the direction of the handrail into the upper end of a wall-side fitting whose lower end is mounted on the wall and is pushed to one side in a leaf spring shape in the direction of the wall and by fitting the handrail-side fitting and the wall-side fitting together.

Thus, the handrail is firmly mounted on the wall by mounting the handrail on the wall by such a fitting.

Finger injuries can be avoided by providing a first finger rest portion with a height of several millimeters to about 1 cm at a position parallel to the wall on the wall side of the top surface. For example, in a case of a plastered wall with fine asperities, when a person grasps a handrail, the fingers of the person may rub against the wall, causing injury, which can be prevented. The height of the finger rest portion is preferably 5 mm or less. In addition, the handrail can be easily grasped in various grasping manners by further providing the second finger rest portion and the third finger rest portion on the front surface. Thereby, a person with weakened grasping power can easily use the handrail. In addition, any edge is chamfered to form the entire handrail by only curved lines, thereby enabling smooth guidance of the fingers and smooth movement of the fingers along the handrail when the handrail is re-grasped, and preventing injury.

The handrail form is very beautiful and cannot be identified as a handrail by appearance, and thus, even when it is mounted, the house cannot be identified as one with a handrail by appearance. Rather, the handrail can be used as a design added to the house. The material of such a handrail is matched to the material of other portions of the house such as a baseboard, thereby further improving design effects, which helps people with walking difficulty such as elderly people, physically challenged people, and even healthy people with poor physical conditions to support the body or move.

DETAILED DESCRIPTION OF THE INVENTION

A first embodiment illustrates a best mode.

FIGS. 1 to 7 illustrate a handrail according to the first embodiment. According to the present application, the term "upward" (or top or above) refers to the direction of the ceiling when the handrail is mounted; "downward" (or below) refers to the direction of the floor; "front" refers to the side of the user of the handrail; and "rear" refers to the wall side.

Figure 1:
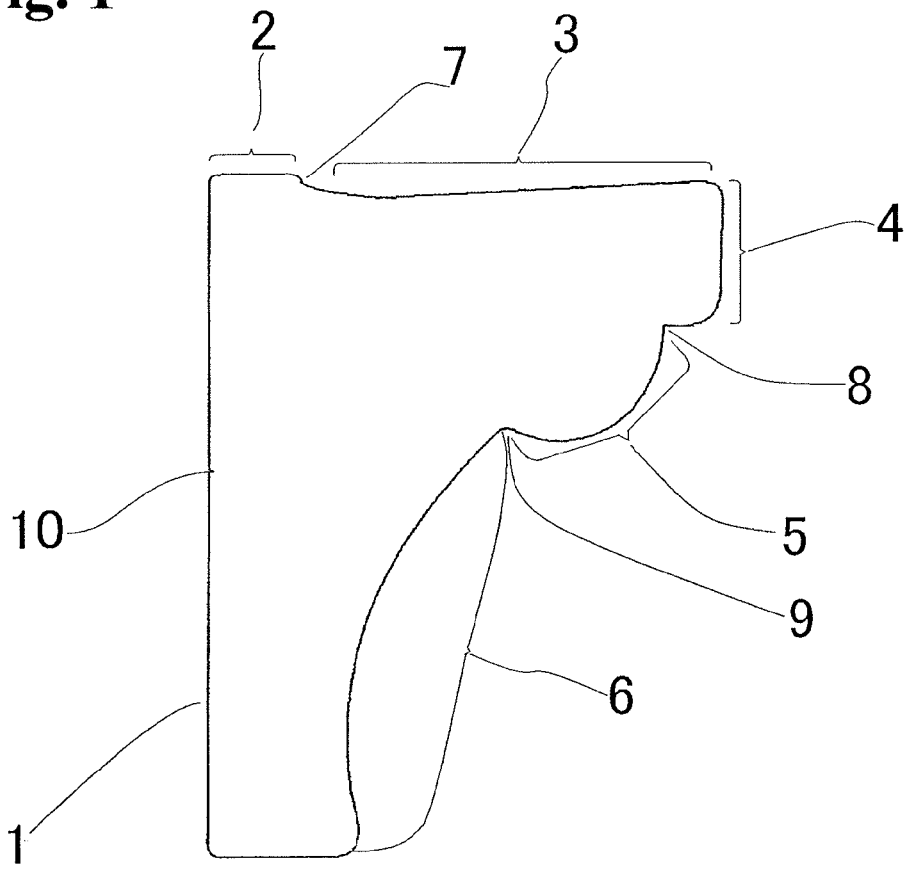
FIG. 1 illustrates a cross-sectional shape of a handrail according to the present invention.

With reference to FIG. 1, the shape of the handrail according to the first embodiment is illustrated in the cross section. The handrail (1) includes a first flat portion (2) and a second flat portion (3) on a top surface thereof. A first finger rest portion (7) is provided at a boundary between the first flat portion (2) and the second flat portion (3). In addition, the handrail (1) includes a first guiding portion (4), a second guiding portion (5), and a third guiding portion (6) on the front; a second finger rest portion (8) is provided at a boundary between the first guiding portion (4) and the second guiding portion (5); and a third finger rest portion (9) is provided at a boundary between the second guiding portion (5) and the third guiding portion (6). Further, the handrail (1) includes a mounting portion (10) that serves as a surface to be mounted on a wall, on the rear surface.

Figure 2:
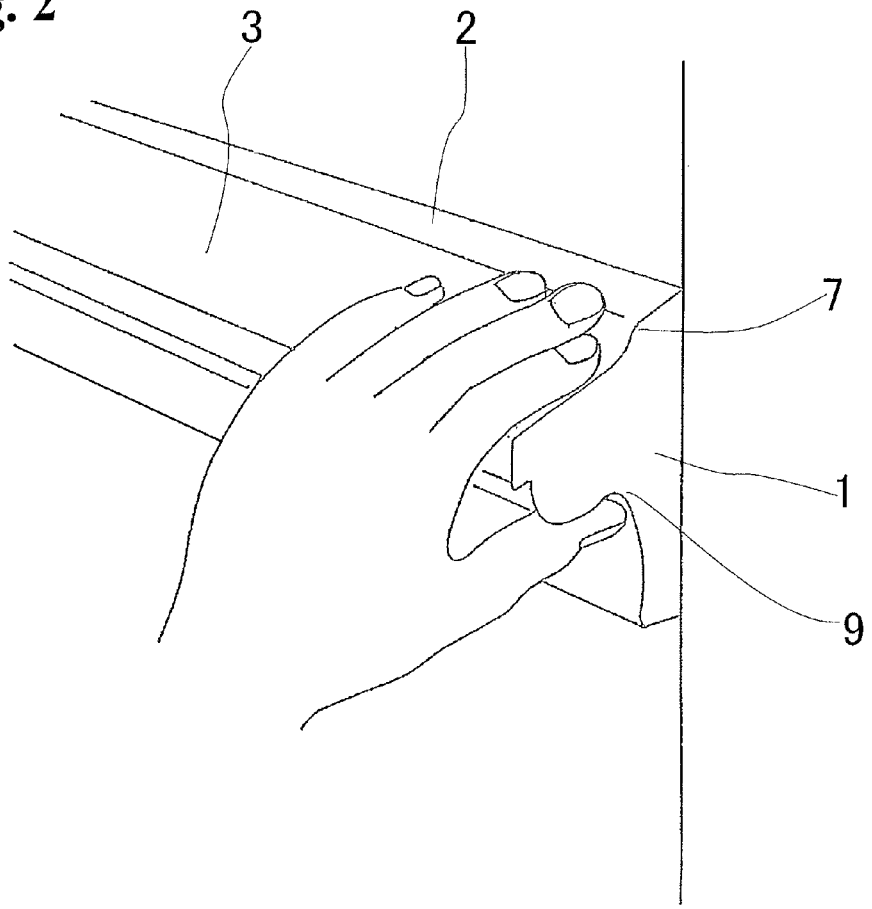
FIG. 2 illustrates a state in which a user grasps the handrail according to the present invention.
Figure 3:
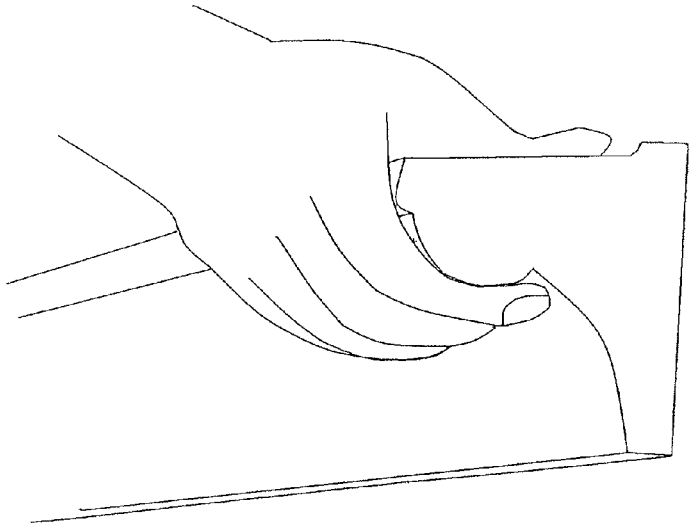
FIG. 3 illustrates a state in which the user grasps the handrail according to the present invention.
Figure 4:
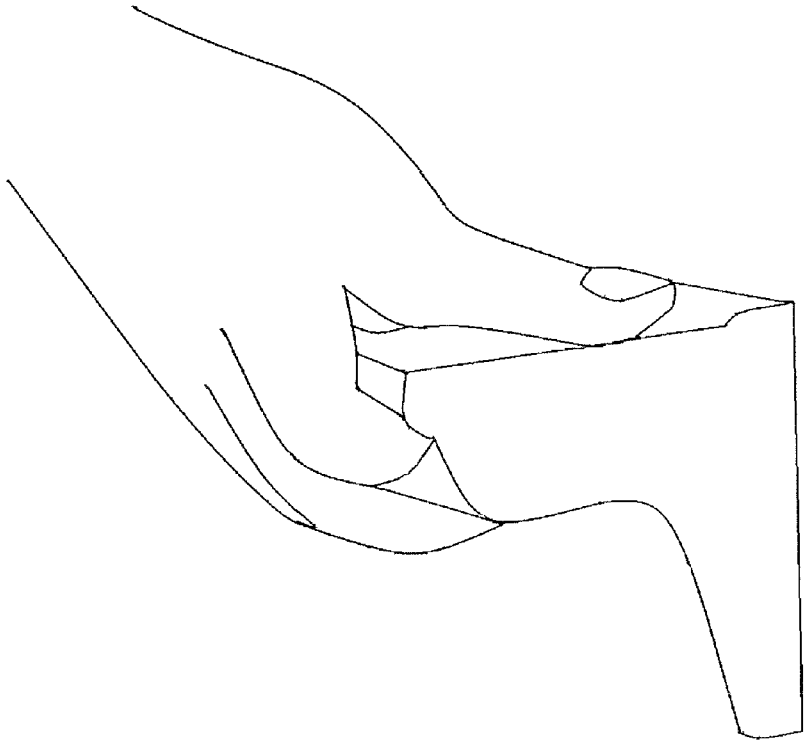
FIG. 4 illustrates a state in which the user grasps the handrail according to the present invention.

FIGS. 2 to 4 each illustrate a state in which a user grasps the handrail according to the first embodiment. The user of the handrail grasps the handrail from various directions depending on the position of the body of the user. In addition, the user grasps the handrail in various manners depending on which part of the hand is used to strongly grasp the handrail. The Figures illustrate examples of these use states.

In FIG. 2, the thumb is placed on the third finger rest portion (9); and the index finger, the middle finger, the ring finger, and the little finger are placed on the first finger rest portion (7). When the user starts to grasp the handrail, the user may approach the handrail from above or may approach the handrail from below depending on the posture of the user. When the user approaches the handrail from below, the thumb moves along the third guiding portion (6) from below to above and stops at the third finger rest portion (9) to grasp the entire handrail. The palm comfortably wraps the handrail along the second guiding portion (5); and the index finger, the middle finger, the ring finger, and the little finger extend along the first flat portion (2). As a result, the handrail is firmly grasped by the entire hand.

In FIG. 3, the tip of the thumb is placed on the first finger rest portion (7); and the tips of the index finger, the middle finger, the ring finger, and the little finger are placed on the third finger rest portion (9). The entire thumb extends along the first flat portion (2); all of the index finger, the middle finger, the ring finger, and the little finger extend along the first guiding portion (4) and the second guiding portion (5); and the palm is not used much to grasp the handrail. However, all of the five fingers are used to firmly grasp the handrail.

In FIG. 4, the second joint and the third joint of the index finger are placed on the second finger rest portion (8); and the middle finger and the ring finger are placed on the third finger rest portion (9). The entire thumb extends along the first flat portion (2); and a portion around the base of the thumb of the palm extends along the first flat portion (2) and the first guiding portion (4). The little finger and the palm except the base of the thumb are not used much to grasp the handrail.

Figure 5:
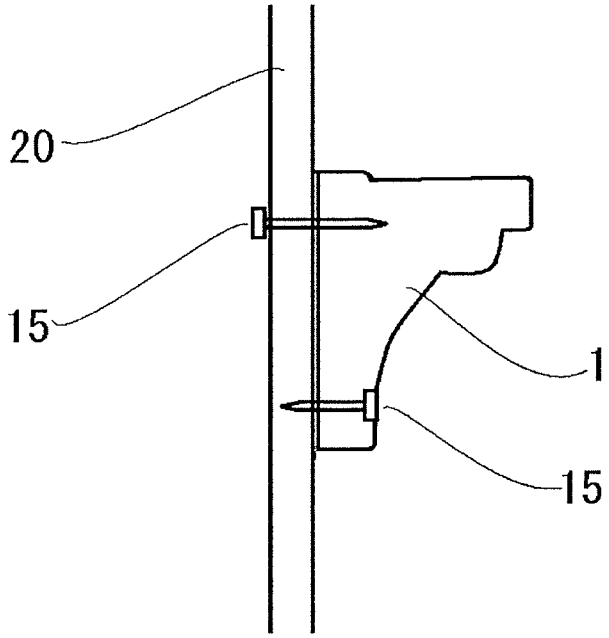
FIG. 5 illustrates a method of mounting the handrail according to the present invention on a wall.
Figure 6:
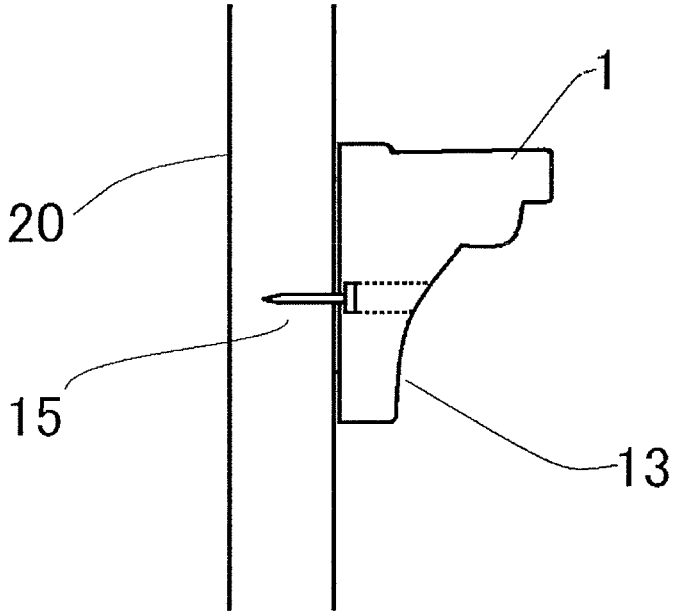
FIG. 6 illustrates a method of mounting the handrail according to the present invention on the wall.
Figure 7:
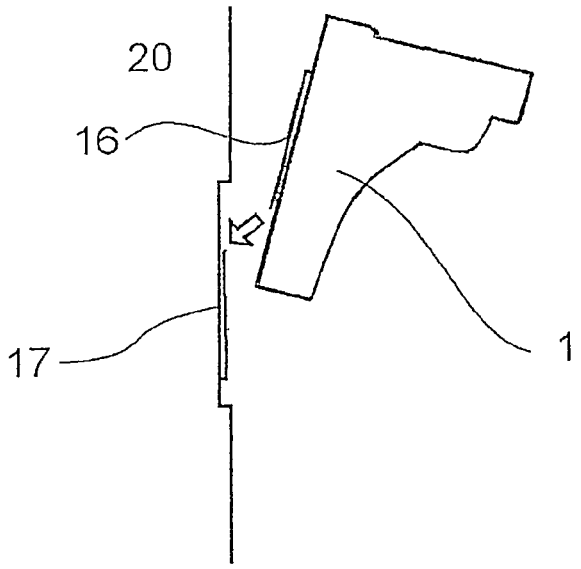
FIG. 7 illustrates a method of mounting the handrail according to the present invention on the wall.

The handrail (1) is firmly mounted on the wall by methods as illustrated in FIGS. 5 to 7. In FIG. 5, the handrail is mounted on the wall by mounting screws (15) from both inside and outside the wall (room side). In FIG. 6, a mounting hole (13) is provided in the handrail and the handrail is mounted on the wall by mounting screws (15) from outside the wall. In FIG. 7, the handrail is mounted on the wall by fittings. The fittings include a fitting (17) whose lower end is mounted on a wall (20) and whose upper end is a free end and is pushed to one side in a leaf spring shape in the direction of the wall; and a fitting (16) whose upper end is mounted on the handrail (1) and whose lower end is a free end and is pushed to one side in a leaf spring shape in the direction of the handrail. The handrail is mounted by inserting the lower end of the fitting 16 from the upper end of the fitting 17 and fitting them together.

The method of mounting the handrail on the wall is appropriately selected according to the strength and the thickness of the wall or the material of the wall. According to the methods in FIGS. 6 and 7, the handrail can also be mounted later after the room is completed.

Figure 8:
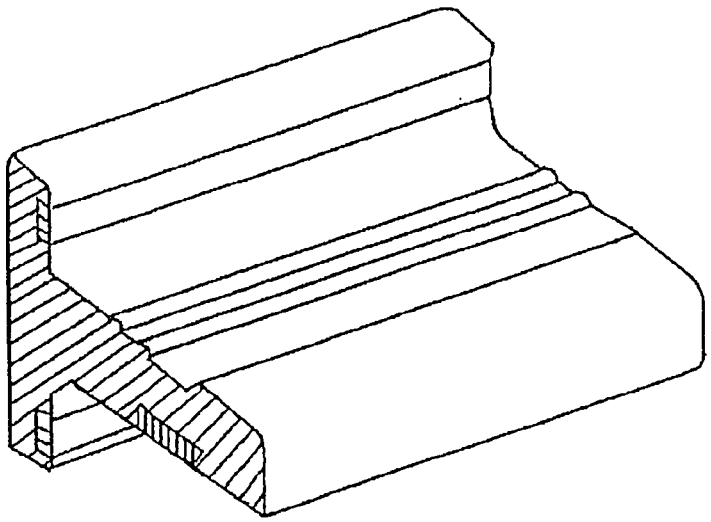
Fig. 8 Prior Art
FIG. 8 illustrates a handrail according to a conventional example.
Figure 9:
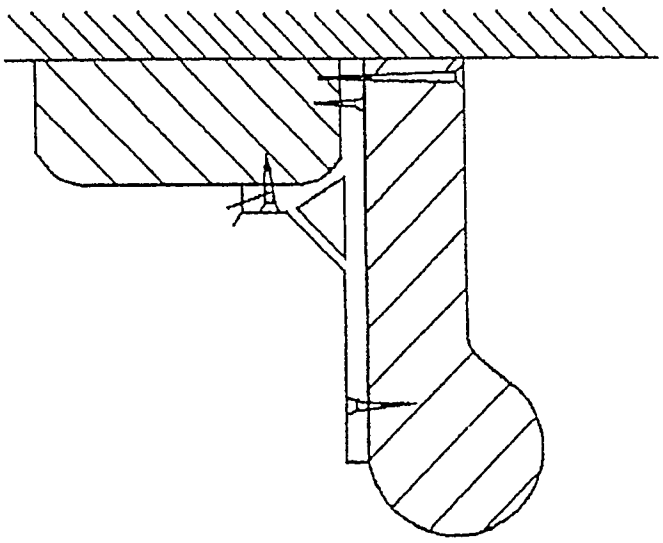
Fig. 9 Prior Art
FIG. 9 illustrates a handrail according to a conventional example.

Six surfaces of a part of the handrail are illustrated by photos. FIG. 8 illustrates the front surface; FIG. 9 illustrates the rear surface; FIG. 10 illustrates the top surface; FIG. 11 illustrates the bottom surface; FIG. 12 illustrates the right side surface; and FIG. 13 illustrates the left side surface.

INDUSTRIAL APPLICABILITY

The handrail according to the present invention can be mounted on walls, hallways, staircases and other structures and used in houses of elderly people and physically challenged people. In addition, the handrail is excellent in design and cannot be considered as a handrail and thus can also be used in houses of healthy people. The handrail can also be mounted when the house is constructed or reformed, and can also be added later separately.

In addition, the handrail according to the present invention can also be used in hospitals, facilities for the elderly and other facilities.

The invention claimed is:

1. A handrail comprising:

a top surface having a first flat portion extending in a first direction, a first finger rest portion continuously extending downward from an end of the first flat portion, and a second flat portion continuously extending in the first direction from an end of the first finger rest portion;

a front surface having a flat first guiding portion continuously extending downward from an end of the second flat portion, a second finger rest portion that is flat and continuously extends from an end of the first guiding portion in a second direction opposite to the first direction, a second guiding portion continuously projecting downward from an end of the second finger rest portion in a convex arc shape, a third guiding portion continuously projecting downward in a concave arc shape in the second direction from an end of the second guiding portion, a third finger rest portion formed at a boundary between the second guiding portion and the third guiding portion extending upward, and a flat surface portion extending in the second direction from an end of the third guiding portion; and a rear surface having amounting portion with a flat surface extending between another end of the first flat portion and another end of the flat surface portion, wherein the handrail is structured so that when the handrail is grasped, fingers are adapted to be placed on at least one of the first finger rest portion, the second finger rest portion, and the third finger rest portion, the first finger rest portion is curved inwardly from the end of the first flat portion to another end of the second flat portion such that the second flat portion is inclined relative to the first flat portion to connect to the first guiding portion, and the second guiding portion has a curved portion curved downwardly from the end of the second finger rest portion to another end of the third guiding portion, and a lower end of the curved portion of the second guiding portion is connected to the another end of the third guiding portion such that the third finger rest portion is formed at a position toward the second flat portion relative to the lower end of the curved portion and the another end of the arc shape portion.

2. A handrail comprising:

a top surface having a first flat portion extending in a first direction, a first finger rest portion continuously extending 1 cm downward from an end of the first flat portion, and a second flat portion continuously extending in the first direction from an end of the first finger rest portion;

a front surface having a flat first guiding portion continuously extending downward from an end of the second flat portion, a second finger rest portion that is flat and continuously extends in a second direction opposite to the first direction from an end of the first guiding portion, a second guiding portion continuously projecting downward in a convex arc shape from an end of the second finger rest portion, a third guiding portion continuously projecting downward in concave arc shape in the second direction from an end of the second guiding portion, a third finger rest portion formed at a boundary between the second guiding portion and the third guiding portion extending upward, and a flat surface portion extending in the second direction from an end of the third guiding portion;

a rear surface having a mounting portion with a flat surface extending between another end of the first flat portion and another end of the flat surface portion;

a first handrail fitting portion having an upper end mounted on the rear surface of the handrail and a lower free end sided in a direction of the handrail; and a second handrail fitting portion having a lower end adapted to be mounted on a wall and an upper free end sided in a direction of the wall for connecting with the first handrail fitting portion, wherein the handrail is structured so that when the handrail is grasped, fingers are adapted to be placed on at least one of the first finger rest portion, the second finger rest portion, and the third finger rest portion, the lower end of the first handrail fitting portion is pushed into the upper end of the second handrail fitting portion to fit the first handrail fitting portion and the second handrail fitting portion together and mount the handrail on the wall, the first finger rest portion is curved inwardly from the end of the first flat portion to another end of the second flat portion such that the second flat portion is inclined relative to the first flat portion to connect to the first guiding portion, and the second guiding portion has a curved portion curved downwardly from the end of the second finger rest portion to another end of the third guiding portion, and a lower end of the curved portion of the second guiding portion is connected to the another end of the third guiding portion such that the third finger rest portion is formed at a position toward the second flat portion relative to the lower end of the curved portion and the another end of the arc shape portion.

* * * * *